US008262543B1

(12) United States Patent
Batca

(10) Patent No.: US 8,262,543 B1
(45) Date of Patent: Sep. 11, 2012

(54) LEG EXERCISE MACHINE WITH MULTI EXERCISE CAPABILITY

(76) Inventor: Roger Batca, Durham, NC (US)

( * ) Notice: Subject to any disclaimer, the term of this patent is extended or adjusted under 35 U.S.C. 154(b) by 141 days.

(21) Appl. No.: 12/909,899

(22) Filed: Oct. 22, 2010

Related U.S. Application Data

(63) Continuation-in-part of application No. 11/934,922, filed on Nov. 5, 2007, now Pat. No. 7,981,011.

(60) Provisional application No. 60/858,086, filed on Nov. 10, 2006, provisional application No. 61/279,562, filed on Oct. 22, 2009.

(51) Int. Cl.
*A63B 21/062* (2006.01)

(52) U.S. Cl. ..... 482/100; 482/93; 482/138

(58) Field of Classification Search ..... 482/92, 482/93, 94, 95, 97, 98, 99, 100, 101, 133, 482/134, 135, 136, 137, 138, 139, 142, 148, 482/908

See application file for complete search history.

(56) References Cited

U.S. PATENT DOCUMENTS

| | | | | |
|---|---|---|---|---|
| 4,535,985 | A * | 8/1985 | Mask | 482/94 |
| 4,822,038 | A * | 4/1989 | Maag | 482/97 |
| 4,883,270 | A * | 11/1989 | Maag | 482/97 |
| 5,366,432 | A * | 11/1994 | Habing et al. | 482/138 |
| 5,484,365 | A * | 1/1996 | Jones et al. | 482/97 |
| 5,554,090 | A * | 9/1996 | Jones | 482/97 |
| 5,653,667 | A * | 8/1997 | Reyes | 482/121 |
| D513,289 | S * | 12/2005 | Panatta | D21/676 |
| 7,115,080 | B2 * | 10/2006 | Cockrill et al. | 482/138 |
| 7,981,011 | B1 * | 7/2011 | Batca | 482/100 |
| 2010/0022360 | A1 * | 1/2010 | Glynn | 482/93 |
| 2010/0279821 | A1 * | 11/2010 | Cole et al. | 482/4 |
| 2010/0331144 | A1 * | 12/2010 | Rindfleisch | 482/6 |

* cited by examiner

*Primary Examiner* — Loan Thanh
*Assistant Examiner* — Tam Nguyen
(74) *Attorney, Agent, or Firm* — Coats & Bennett, P.L.L.C.

(57) ABSTRACT

A leg exercise machine comprises a user support assembly pivotally attached to a sub frame that is linearly attached to a main support frame. The sub frame linearly travels back and forth during leg press exercise and extended leg calf raise exercise. The user support assembly pivots up and down during seated calf raise exercise. A movable brace assembly mounted to the user support assembly adjusts to a first position for engaging a user's legs during seated calf raise exercise and a second position storing the brace assembly during leg press exercise.

19 Claims, 14 Drawing Sheets

LEG EXERCISE MACHINE WITH MULTI EXERCISE CAPABILITY

RELATED APPLICATIONS

This application is being filed as a continuation-in-part of U.S. patent application Ser. No. 11/934,922, filed Nov. 5, 2007, now U.S. Pat. No. 7,981,011 which claims priority to U.S. Provisional Application 60/858,086 filed Nov. 10, 2006; and also claims priority to U.S. Provisional Application 61/279,562 filed Oct. 22, 2009, all of which are incorporated herein by reference.

FIELD OF THE INVENTION

The present invention is directed generally to exercise equipment and, more particularly, an exercise machine to perform leg presses and calf raises.

BACKGROUND

Various types of exercise machines for strengthening and conditioning the body are known. One type of exercise machine is a combination leg press and extended leg calf raise machine which typically has a common user support for the user to sit on and a foot platform to put their feet on while performing leg presses or calf raises. To perform leg presses a user sits on the user support which includes a bottom and back seat, adjusts the back seat according to user size and stretch, and places their entire feet on the foot platform. The user then presses the platform in a back and forth fashion to perform leg presses. During exercise the foot platform will either pivot back and forth, the foot platform will linearly move back and forth, or the user support will linearly move back and forth based upon the design of the combination leg press and calf raise machine. Resistance is typically connected to the foot platform or the user support. This will exercise the upper leg and glute muscles of the user.

To perform extended leg calf raises on this same machine a user sits on the user support, adjusts the back seat according to user size and stretch, and outwardly stretches their legs and places the balls of their feet on the bottom of the foot platform. The user then pivots their feet at their ankles which will cause the foot platform to move away from the user. The user repeats this pivot motion for the desired number of repetitions. This will exercise the user's calf muscles. This will also exercise the leg and glute muscles because the user's legs are in an outwardly stretched position which help support the calf muscles while exercising. This type of extended leg calf raise exercise does not isolate a user's calf muscles during exercise.

U.S. patent application Ser. No. 11/934,922, wherein Roger Batca is the inventor, shows a combination exercise machine that allows a user to perform leg presses, extended leg calf raises, as well as seated calf raises which isolate the calf muscles. To perform leg presses and extended leg calf raises a user sits on a pivotally attached user support assembly and presses a pivotally attached foot platform outward. To perform seated calf raises a user sits on the user support assembly placing their legs in a generally ninety degree position, adjusts a movable brace pad assembly to an upward position, and presses a multi function handle bar assembly to lift the user support assembly to allow the brace pad assembly to be positioned above the knees to support the legs. The user then pivots their feet at the ankles causing the user support to pivot up and down. This will isolate the user's calf muscles during exercise.

It is a belief among fitness professionals that exercising one's muscles with different types of movements and angles provides optimal muscle growth. As mentioned in paragraph two above, leg press machines can be designed and made wherein the user support assembly or the foot platform can linearly move back and forth during leg press exercise. Thus it would also be advantageous to have a leg exercise machine that would allow a user to perform linear motion leg presses and extended calf raises, as well as pivotal motion seated calf raises to isolate the calf muscles during exercise. Combination exercise machines are cost efficient to manufacture and space efficient because numerous stations can share the same framework and the same resistance load.

SUMMARY

The present invention is directed to a leg exercise machine that provides means for a user to perform linear motion leg presses and extended leg calf raises as well as pivotal motion seated calf raises.

The leg exercise machine comprises a main support frame, a linearly attached sub frame, a pivotally attached user support assembly, a multi function handle bar assembly, a resistance element, and a flexible connector system connecting the user support assembly and the linearly attached sub frame to the resistance element. In the exemplary embodiment, the resistance element is a weight stack and the flexible connector system is a cable system.

In an exemplary embodiment, a linearly attached sub frame supports a pivotally attached user support assembly and includes rollers that support and guide the sub frame along two rods attached to the main support frame. The user support assembly comprises a seat frame assembly, a pivotally attached bottom seat assembly for a user to sit on, and a pivotally attached brace assembly to support a user's legs above the knees during seated calf raises. The brace assembly includes a brace housing and a pad assembly which telescopically adjusts into the brace housing. The pad assembly includes brace pads that adjust to a storage position below the user's legs when the user performs leg presses and extended leg calf raises, and adjust to a use position above the user's legs during seated calf raises. A multi function handle bar assembly, which is pivotally attached to the sub frame, can be pressed to lift the user support assembly to allow the user to position their feet on foot plates mounted on the sub frame when positioning for seated calf raises.

During seated calf raises, the user support assembly pivots up and down and the linearly attached sub frame remains in a bumpered rest position. During leg presses and extended leg calf raises, the user support assembly remains in a bumpered rest position as the sub frame linearly moves back and forth as a user presses their feet against a stationary foot platform on the main support frame. A cable assembly connects the user support assembly and the sub frame to the weight stack which provides resistance to the user.

In an alternate embodiment, a bottom seat assembly is pivotally attached to the sub frame. A pivot arm assembly is pivotally attached to the sub frame underneath the bottom seat assembly. The brace pad assembly is attached to the pivot arm assembly. As in the exemplary embodiment, the brace pads of the pad assembly adjust to a storage position below the user's legs when the user performs leg presses and extended leg calf raises, and adjust to a use position above the user's legs during seated calf raises. A multi-function handle bar assembly, which is pivotally attached to the sub frame, can be pressed to lift the pivot arm assembly to allow the user to position their feet on foot plates mounted on the sub frame when positioning for seated calf raises.

During seated calf raises, the pivot arm assembly pivots up and down and the linearly attached sub frame remains in a bumpered rest position. During leg presses and extended leg calf raises, the pivot arm assembly remains in a bumpered rest position as the sub frame linearly moves back and forth as a user presses their feet against a stationary foot platform on the main support frame. A cable assembly connects the pivot arm assembly and the sub frame to the weight stack which provides resistance to the user.

In another alternate embodiment, a user support assembly is pivotally attached to the main support frame rather than to a linearly attached sub frame, and pivots up and down during seated calf raises as described in the exemplary embodiment. A sub frame including a foot platform is linearly attached to the main support frame and moves back and forth during leg presses and extended leg calf raises as the user support assembly remains stationary. Other aspects and embodiments of the invention will become apparent in the detailed description.

DETAILED DESCRIPTION

Figure 1:
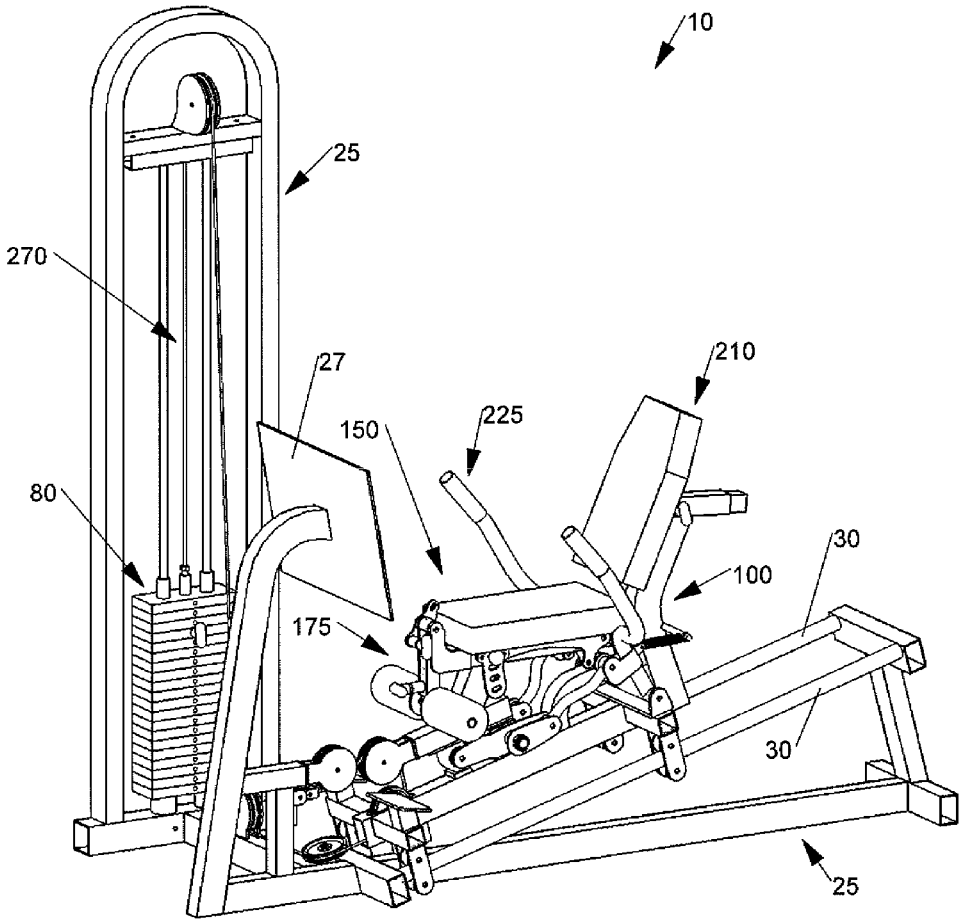
FIG. 1 is a perspective view illustrating an exemplary leg exercise machine according to the present invention from the front left side.
Figure 1:
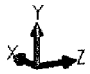
Figure 2:
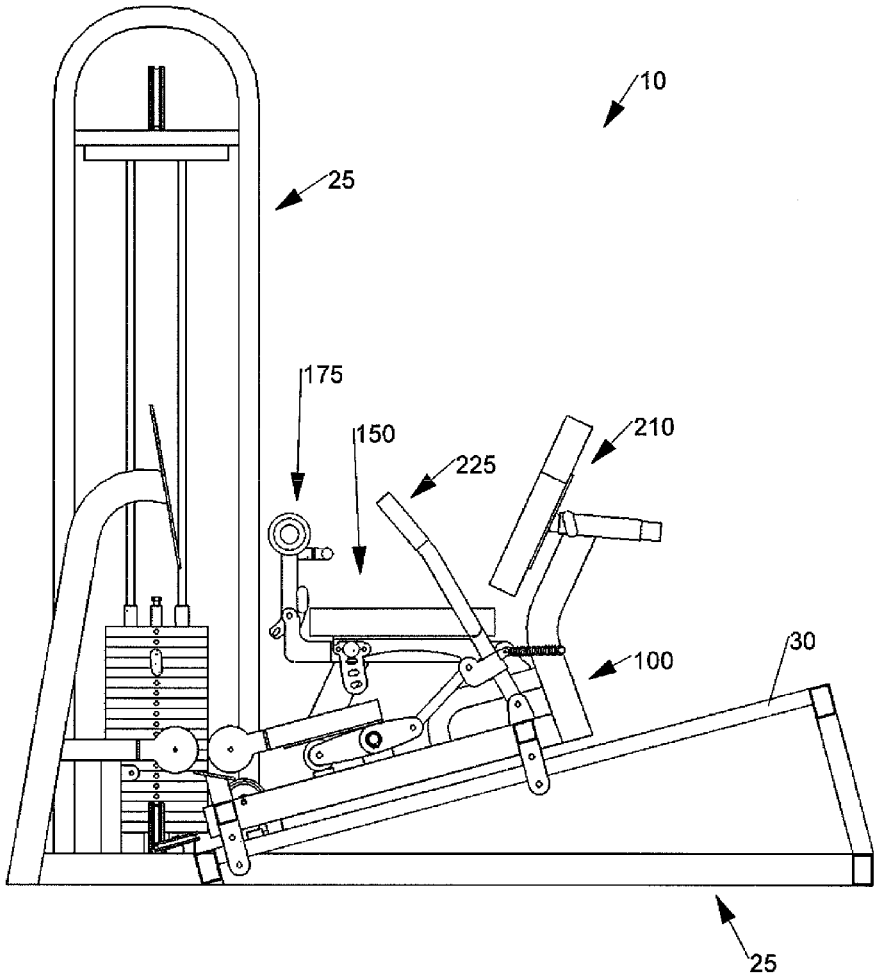
FIG. 2 is a side view illustrating an exemplary leg exercise machine according to the present invention.
Figure 2:
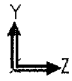

Referring now to the drawings, a leg exercise machine according to the present invention is shown therein and indicated generally by the numeral 10. As shown in FIGS. 1 and 2, the leg exercise machine 10 comprises a main support frame 25, weight stack or other resistance element 80, sub frame 100, user support assembly 150, back pad assembly 210, multi function handle bar assembly 225, and connector system 270 interconnecting the sub frame 100 and the user support assembly 150 with the weight stack 80. The exemplary embodiment shown in the drawings is for performing leg presses, extended leg calf raises, and seated calf raises. In the exemplary embodiment, the connector system 270 is a cable and pulley system having at least one flexible line. Those skilled in the art would appreciate that other flexible lines such as belts, straps, chains, ropes, or cords could be used to carry out the present invention. Also, those skilled in the art would appreciate that there are numerous configurations of cables and pulleys that could be used to carry out the present invention.

The main support frame 25, illustrated in FIGS. 1-5, provides structural support and stability to the leg exercise machine 10. The main support frame 25 also houses the resistance element 80, includes linear rods 30 for attaching and providing a linear guide for sub frame 100, includes foot platform 27 for pressing when a user performs leg presses and extended leg calf raises, and provides connection points for the pulleys within connecting system 270.

In the exemplary embodiment, the resistance element 80 is a weight stack which is illustrated in FIGS. 1-5. Weight stacks are commonly used as a resistance element in the art of strength training. Those skilled in the art will appreciate that other resistance devices, such as electronic resistance devices, magnetic breaks, hydraulic cylinders, elastic bands, free weights, or pneumatic resistance may also be used to practice the present invention.

Figure 6:
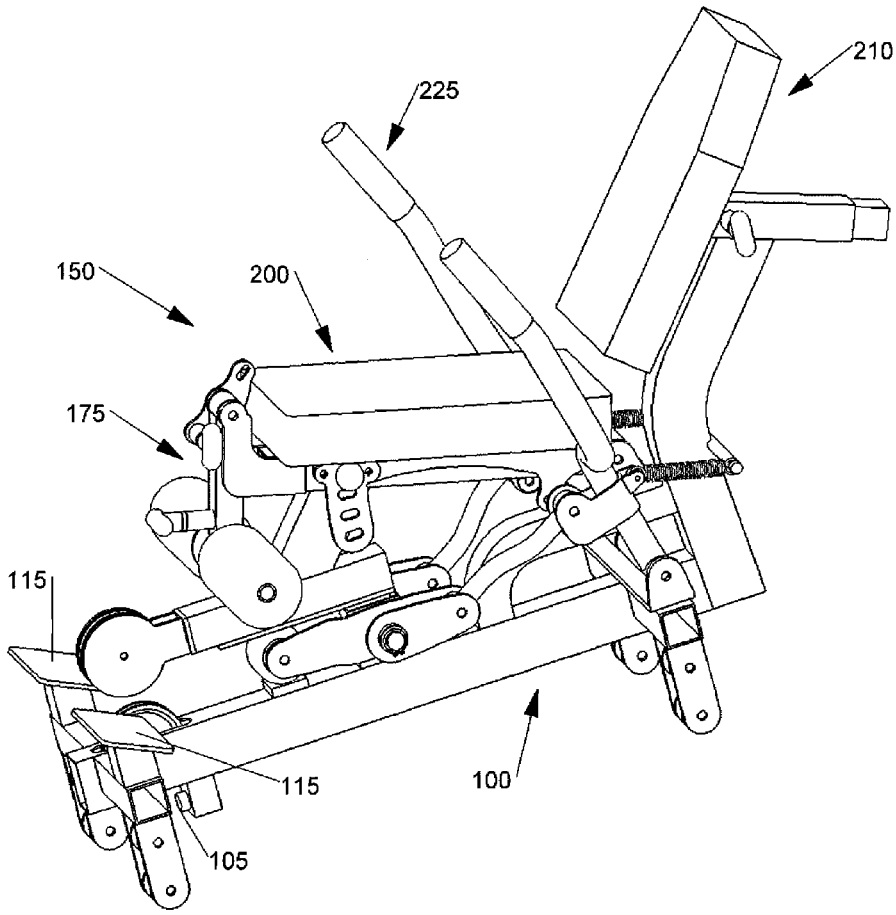
FIG. 6 is a perspective view illustrating an exemplary sub frame and user support assembly.
Figure 6:
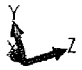
Figure 7:
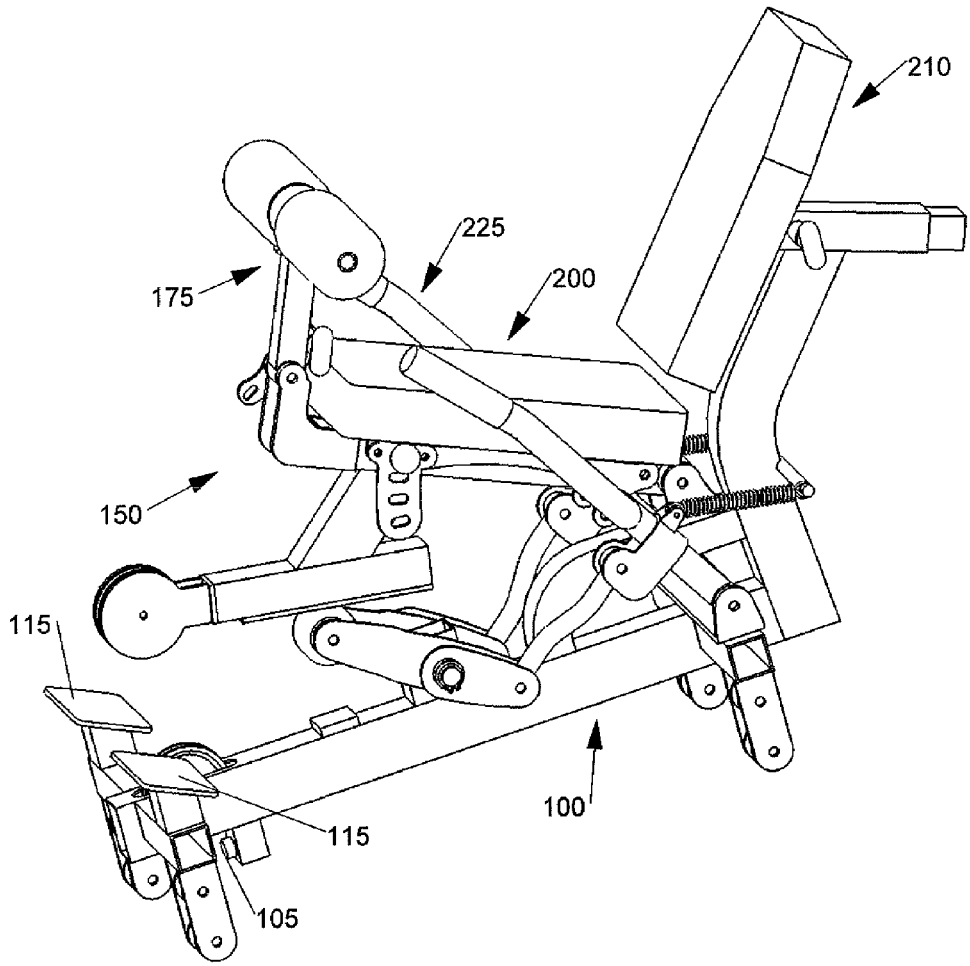
FIG. 7 is a perspective view illustrating an exemplary sub frame and user support assembly wherein the brace assembly is adjusted to a use position for bracing a user's legs while performing seated calf raises and the multi function handle bar assembly is pressed forward thus lifting the user support assembly.
Figure 7:
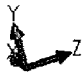
Figure 8:
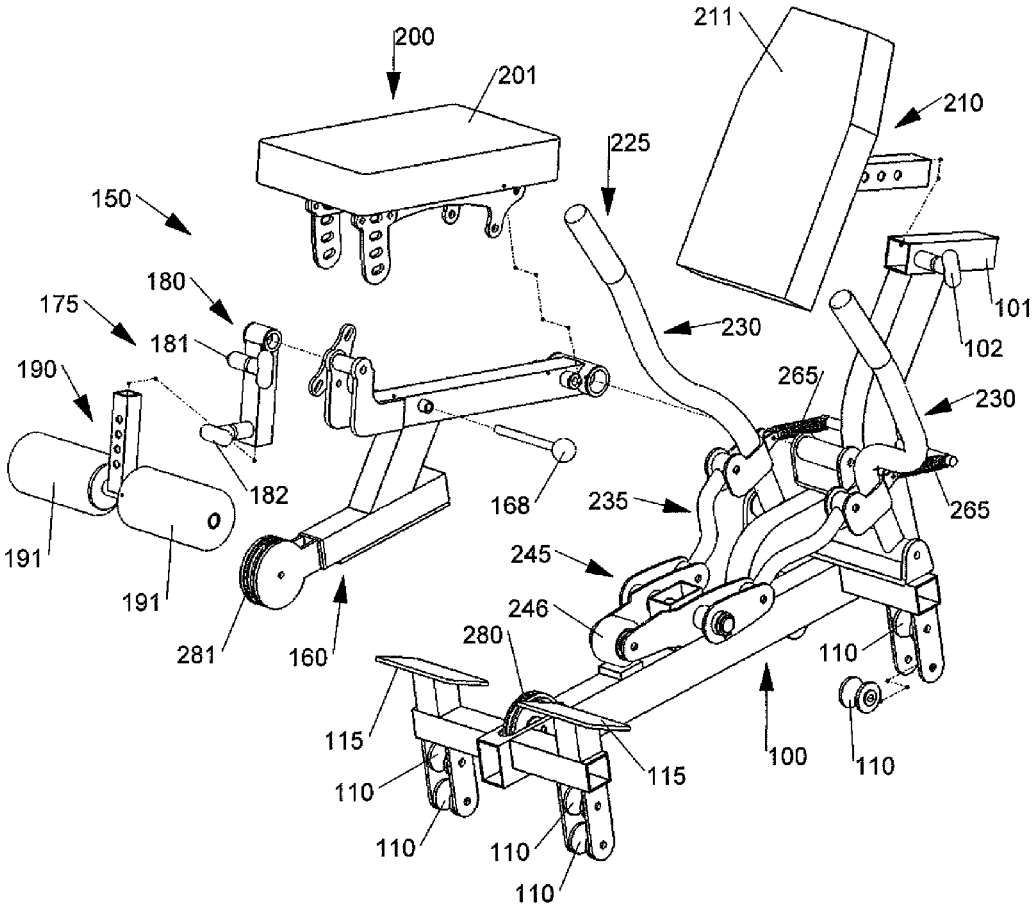
FIG. 8 is an exploded view illustrating an exemplary sub frame and user support assembly.
Figure 8:
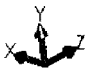

The sub frame 100, illustrated in FIGS. 6-8, provides an attachment axis for user support assembly 150, two attachment axes for multi function handle bar assembly 225, and an attachment sleeve 101 for linearly attaching back seat assembly 210. Sub frame 100 includes foot plates 115 for a user to position their feet on when performing seated calf raises and includes rollers 110 which linearly attach sub frame 100 to main support frame 25 wherein rollers 110 roll along linear rods 30 during leg presses and extended leg calf raises. Other linear motion components could be used to allow sub frame 100 to linearly move along linear rods 30 such as linear bearings or bushings. The sub frame 100 also includes bumper 105 which bumpers against main support frame 25 when in a rest position. Although not shown, a locking mechanism could be added to selectively lock sub frame into main support frame 25 to prevent linear travel if desired.

The user support assembly 150, illustrated in FIGS. 6-8, provides seating for the user while performing leg presses, extended leg calf raises, and seated calf raises. The user support assembly 150 comprises a seat frame assembly 160, a pivotally attached bottom seat assembly 200 for a user to sit on which is locked into the desired angular position by lock pin 168, and a pivotally attached brace assembly 175 to support a user's legs above the knees during seated calf raises.

The brace assembly 175 includes a brace housing 180 and a pad assembly 190 which telescopically adjusts and locks into the brace housing 180 by locking pin 182. Brace housing 180 includes locking pin 181 to lock brace housing 180 into seat frame assembly 160 in an upward or a downward position. Pad assembly 190 includes brace pads 191 which support a user's legs when performing seated calf raises.

Bottom seat assembly 200 pivotally attaches to seat frame assembly 160 and includes bottom seat pad 201 for a user to sit on when performing leg presses, extended leg calf raises, and seated calf raises.

Back pad assembly 210, illustrated in FIGS. 6-8, includes back seat pad 211 and provides back support to a user when performing leg presses, extended leg calf raises, and seated calf raises. Back pad assembly 210 is linearly adjustable into sleeve 101 of sub frame 100 and is secured by locking pin 102.

The multifunction handle bar assembly 225, illustrated in FIGS. 6-8, provides means to lift the user support assembly 150 upward to enable the user to position their feet on and off of the foot plates 115 in the beginning and end of seated calf raises. The multi function handle bar assembly 225 can also be grasped by the user to stabilize the upper body while performing leg presses and extended leg calf raises. The multi function handle bar assembly 225 includes left and right handle bar assemblies 230 that are pivotally attached to the sub frame 100, left and right link assemblies 235 that are pivotally attached to respective handle bar assemblies 230, and wheel assembly 245 which is pivotally attached to sub frame 100 as well as link assemblies 235. Wheel assembly 245 includes wheel 246 which bumpers against sub frame 100 to provide a rest position for multi function handle bar assembly 225 and also serves as a bumper to provide a rest position for user support assembly 150. Multi function handle bar assembly 225 also includes extension springs 265 which also attach to sub frame 100. The extension springs 265 returns the multi function handle bar assembly 225 back to a rest position after the user support assembly 150 is lifted to the desired height.

The connector system 270 connects the linearly attached sub frame 100 and the pivotally attached user support assembly 150 to the weight stack 80. Connector system 270 includes pulley 280 attached to sub frame 100, best illustrated in FIGS. 6-8, and pulley 281 attached to user support assembly 150, best illustrated in FIGS. 6-8. When the sub frame 100 linearly moves outward during leg presses and extended leg calf raises the selected weights in weight stack 80 are lifted. When the user support assembly 150 pivots upward during seated calf raises the selected weights in weight stack 80 are lifted.

FIG. 1 illustrates leg exercise machine 10 wherein sub frame 100 is linearly attached to main support frame 25 and is in a resting position. User support assembly 150 is pivotally attached to sub frame 100 and is in a resting position. Brace assembly 175 is pivotally attached to user support assembly 150 and is in a storage position which allows a user to perform leg presses and extended leg calf raises without interference. FIG. 2 illustrates leg exercise machine 10 wherein brace assembly 175 is in a use position which allows a user to perform seated calf raises.

Figure 3:
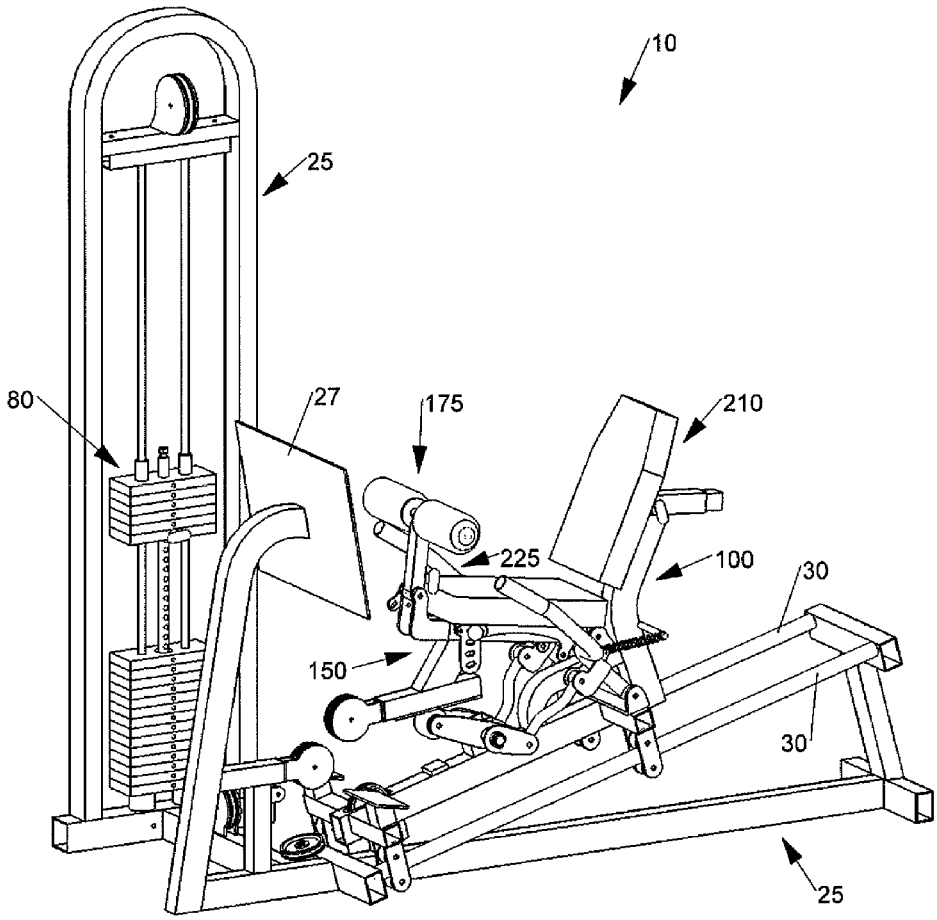
FIG. 3 is a perspective view illustrating an exemplary leg exercise machine from the front left side wherein the brace assembly is adjusted to a use position for bracing a user's legs while performing seated calf raises and the multi function handle bar assembly is pressed forward thus lifting the user support assembly.
Figure 3:
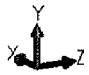
Figure 4:
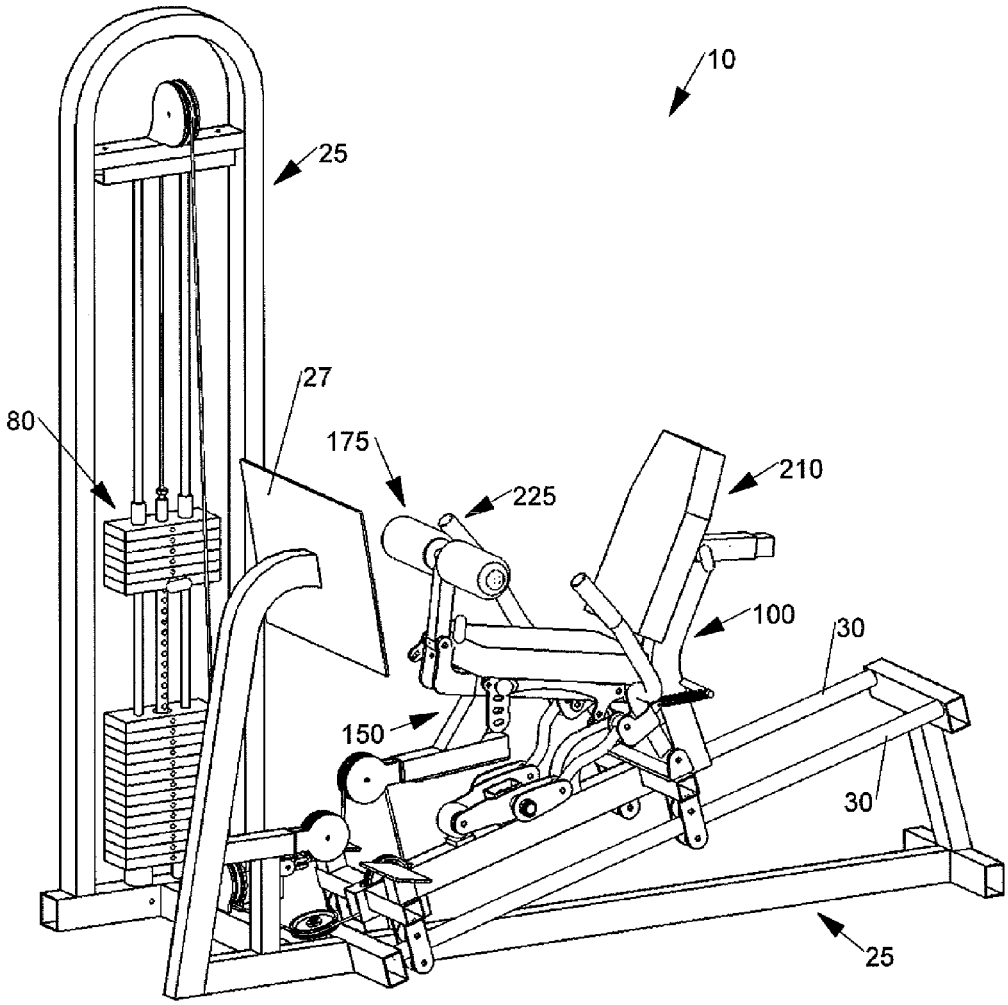
FIG. 4 is a perspective view illustrating an exemplary leg exercise machine from the front left side wherein the brace assembly is adjusted to a use position for bracing a user's legs while performing seated calf raises and the user support assembly is in a lifted position.
Figure 4:
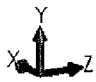

FIG. 3 illustrates leg exercise machine 10 wherein multi function handle bar assembly 225 is pressed forward wherein handle bar assemblies 230 press link assemblies 235 forward which push wheel assembly 245 downward on one end and wherein wheel 246 is pushed up on the other end and rolls along seat frame assembly 160 and lifts user support assembly 150 upward which lifts the selected weights in weight stack 80. This enables the user to position their feet on and off of the foot plates 115 in the beginning and end of seated calf raises. Those skilled in the art will appreciate that there are a variety of configurations of linkages that could be used in order to lift the user support assembly 150. FIG. 4 illustrates leg exercise machine 10 wherein user support assembly 150 is lifted upward in a position during seated calf raises and the multi function handle bar assembly 225 is retracted back into a resting position.

Figure 5:
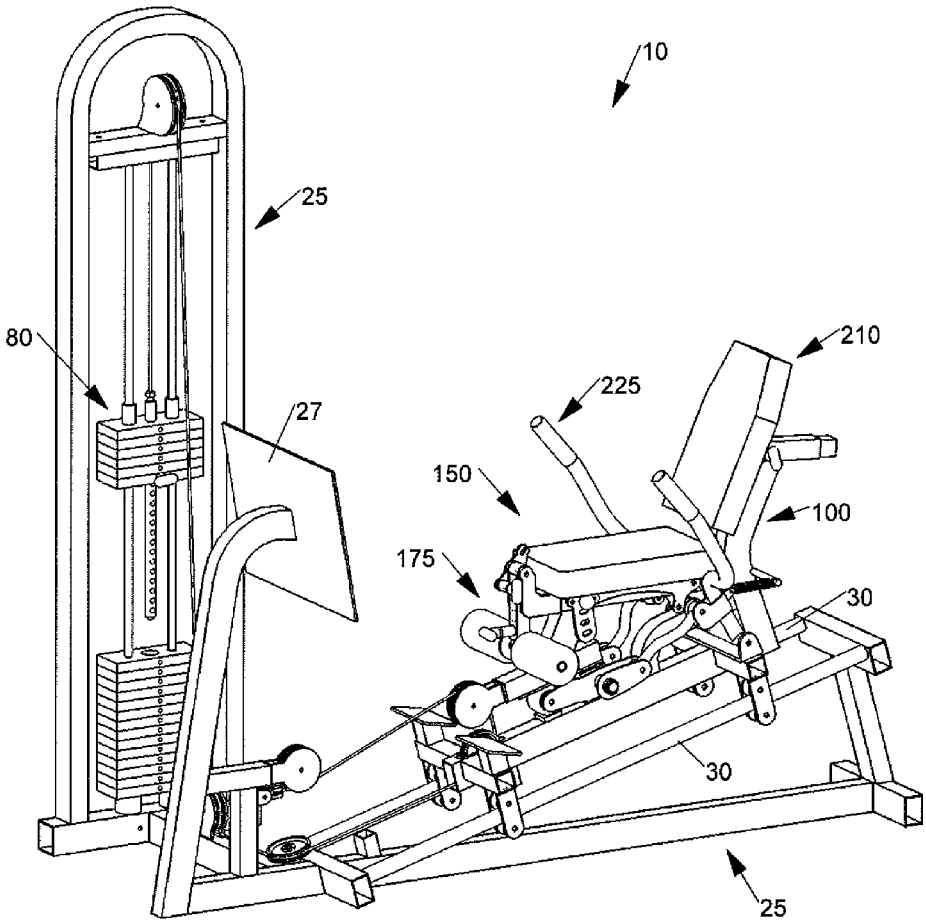
FIG. 5 is a perspective view illustrating an exemplary leg exercise machine from the front left side wherein the sub frame and the user support assembly is pressed into an outward position of a linear path.
Figure 5:
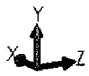

FIG. 5 illustrates leg exercise machine 10 wherein the sub frame 100 and the user support assembly 150 are pressed into an outward position of a linear path during leg presses or extended leg calf raises.

In use, the user will sit on the user support assembly 150 to perform exercise on the leg exercise machine 10. To perform leg presses and extended leg calf raises, the user will adjust the back pad assembly 210 to the desired position based upon user size and desired stretch by unlocking and relocking locking pin 102. The user will then adjust bottom seat assembly 200 to the desired angle by removing lock pin 168, rotating bottom seat assembly 200 to the desired angle, and by re-engaging lock pin 168 into seat frame assembly 160. The user then adjusts the brace pads 191 of the brace assembly 175 to a position below the legs of the user. The user can then grasps the multi function handle bar assembly 225 to stabilize their upper body. The user then presses foot platform 27 for the desired number of repetitions wherein sub frame 100 will linearly travel back and forth which will lift the selected weights in the weight stack 80. The user's body weight while seated on the user support assembly 150 along with cable and pulley system 270 being connected to the user support assembly 150 and pulling the seat support assembly 150 downward will keep the user support assembly 150 in a bumpered and rest position while leg presses and extended leg calf raises are being performed.

To perform seated calf exercises, the user will sit on the bottom seat assembly 200 facing forward and adjust the brace pads 191 of the pad assembly 190 to an upward position above their knees. The user will then press multi function handle bar assembly 225 forward which will raise the user support assembly 150 upward which will raise the selected weights in weight stack 80. The user then places their feet on the foot plates 115. The user will then let the multi function handle bar assembly 225 return to a bumpered rest position. As the user's legs above the knees are braced by the brace pads 191 of the brace assembly 175, they will pivot their feet at their ankles for the desired number of repetitions. This will raise and lower the user support assembly 150 which is connected to the weight stack 80 and provide resistance to the user. When finished performing seated calf exercises, the user will press multi function handle bar assembly 225 forward to re-engage and lift the user support assembly 150 upward. This will lift the brace pads 191 of the brace assembly 175 off of the user's legs above the knees and allow the user to remove their feet off of the foot plates 115. The user will then let the multi function handle bar assembly 225 return to its resting position.

Figure 9:
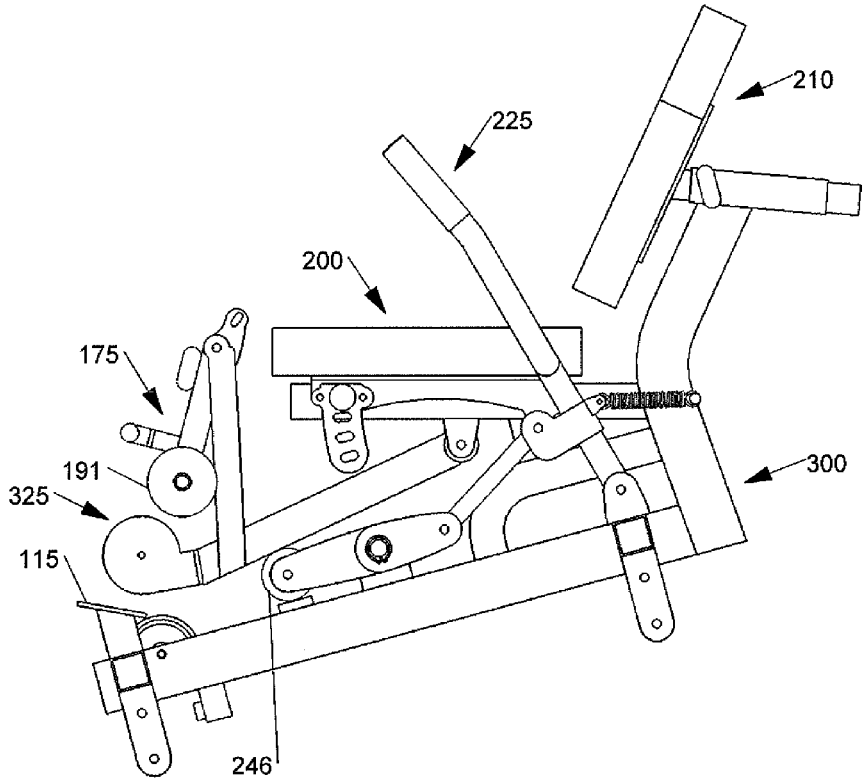
FIG. 9 is a side view of an alternate embodiment sub frame and a pivot arm assembly pivotally attached to the sub frame underneath a bottom seat assembly for performing seated calf raises.
Figure 9:
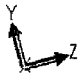
Figure 10:
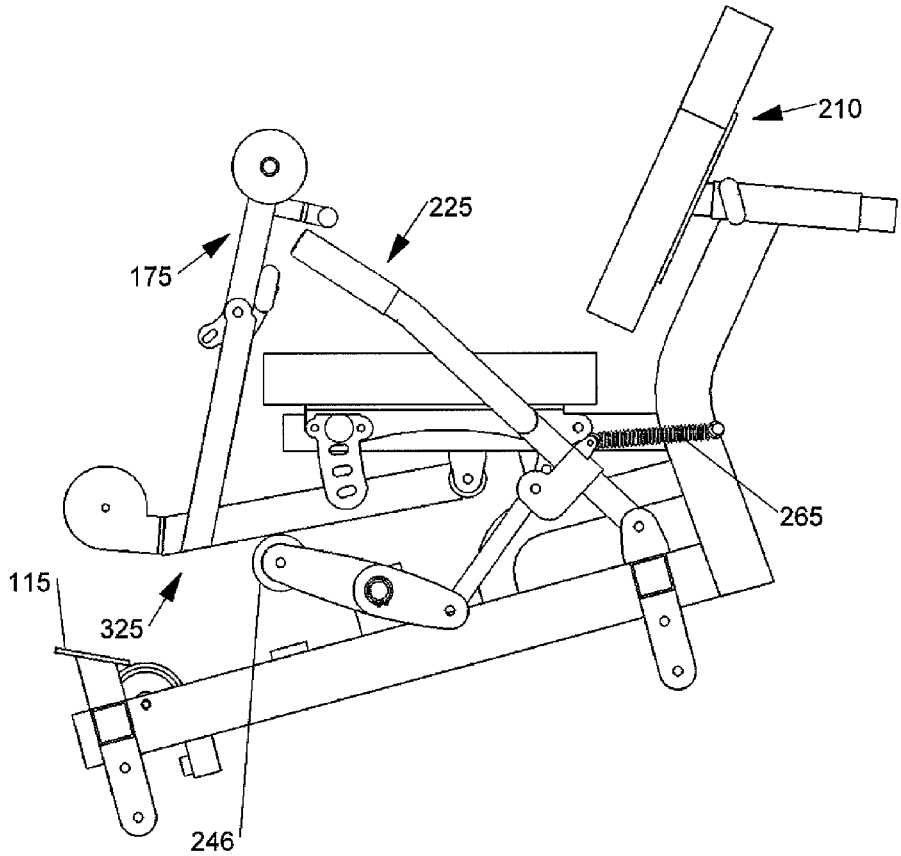
FIG. 10 is a side view of an alternate embodiment sub frame and a pivot arm assembly pivotally attached to the sub frame underneath a bottom seat assembly wherein the brace assembly is adjusted to a use position for bracing a user's legs while performing seated calf raises and the multi function handle bar assembly is pressed forward thus lifting the pivot arm assembly.
Figure 10:
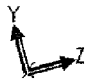

FIG. 9 illustrates an alternate embodiment that includes sub frame 300 and pivot arm assembly 325. A bottom seat assembly 200 is pivotally attached to sub frame 300 and stays in a fixed position during seated calf raises. Bottom seat assembly 200 could be fixedly attached to sub frame 300 to carry out the present invention. Rather than a user support assembly 150 pivoting up and down during seated calf raises, a pivot arm assembly 325 is pivotally attached to sub frame 300 and pivots up and down during seated calf raises. Multi function handle bar assembly 225 functions in the same way in this alternate embodiment as in the exemplary embodiment however wheel 246 rolls along pivot arm assembly 325 rather user support assembly 150 in order to lift pivot arm assembly 325 to allow a user to position their feet on foot plates 115 in the beginning and end of seated calf raises. Pivot arm assembly 325 is pivotally attached to sub frame 300 underneath bottom seat assembly 200 and includes pivotally attached brace assembly 175. Brace assembly 175 adjusts and locks into pivot arm assembly 325 into a position wherein the brace pads 191 are below the user's legs during leg presses and extended leg calf raises and adjusts and locks into pivot arm assembly 325 into a position wherein the brace pads 191 are above the user's legs during seated calf raises. Sub frame 300 linearly mounts to main support frame 25 the same way sub frame 100 of the exemplary embodiment mounts to main support frame 25 and connects to weight stack 80. Pivot arm assembly 325 is connected to weight stack 80 as well and lifts the selected weights when pivot arm assembly 325 is lifted upward. FIG. 10 illustrates multi function handle bar assembly 225 pressed forward thus lifting pivot arm assembly 325 upward wherein brace assembly 175 is adjusted to an upward position for performing seated calf raises. The process to perform leg presses, extended leg calf raises, and seated calf raises is the same in this alternate embodiment as is in the exemplary embodiment.

Figure 11:
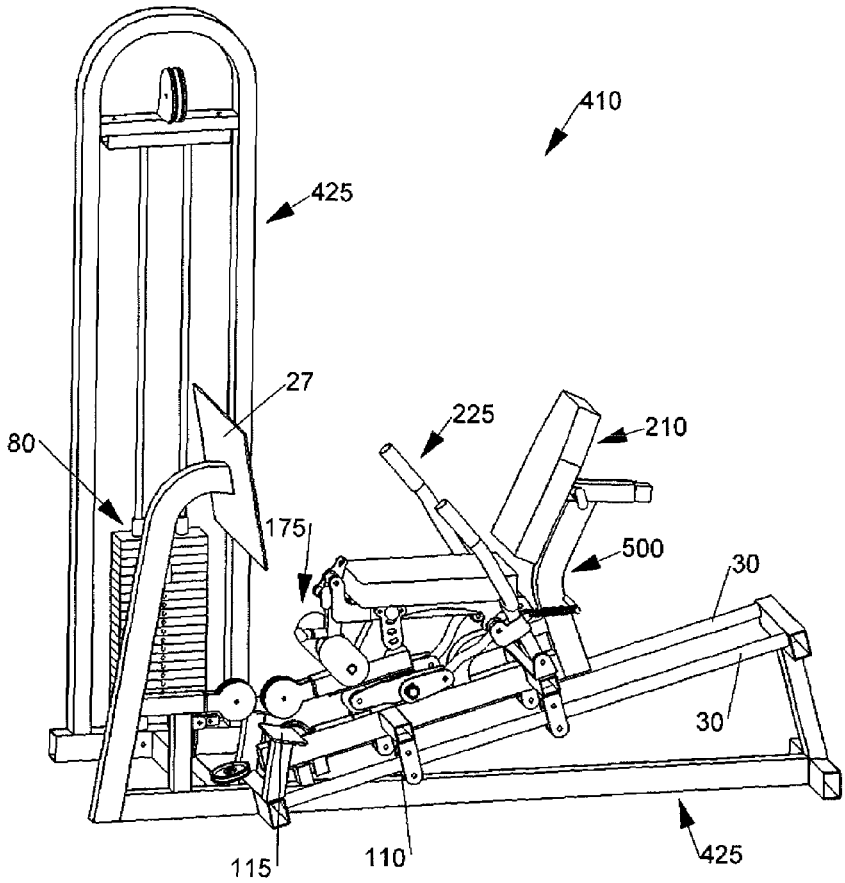
FIG. 11 is a perspective view illustrating an alternate embodiment leg exercise machine wherein the foot plates used for performing seated calf raises are attached to the main support frame rather than the sub frame.
Figure 11:
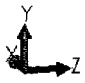

FIG. 11 illustrates an alternate embodiment leg exercise machine 410 that includes an alternate embodiment main support frame 425 and sub frame 500. The only difference between alternate embodiment leg exercise machine 410 and exemplary embodiment leg exercise machine 10 is that foot plates 115 are mounted to the main support frame 425 rather than sub frame 500. The rollers 110 mounted on the front of sub frame 500 are also positioned further towards the rear of sub frame 500 to allow foot positioning on foot plates 115 during seated calf raises. The process to perform leg presses, extended leg calf raises, and seated calf raises is the same in this alternate embodiment as is in the exemplary embodiment.

Figure 12:
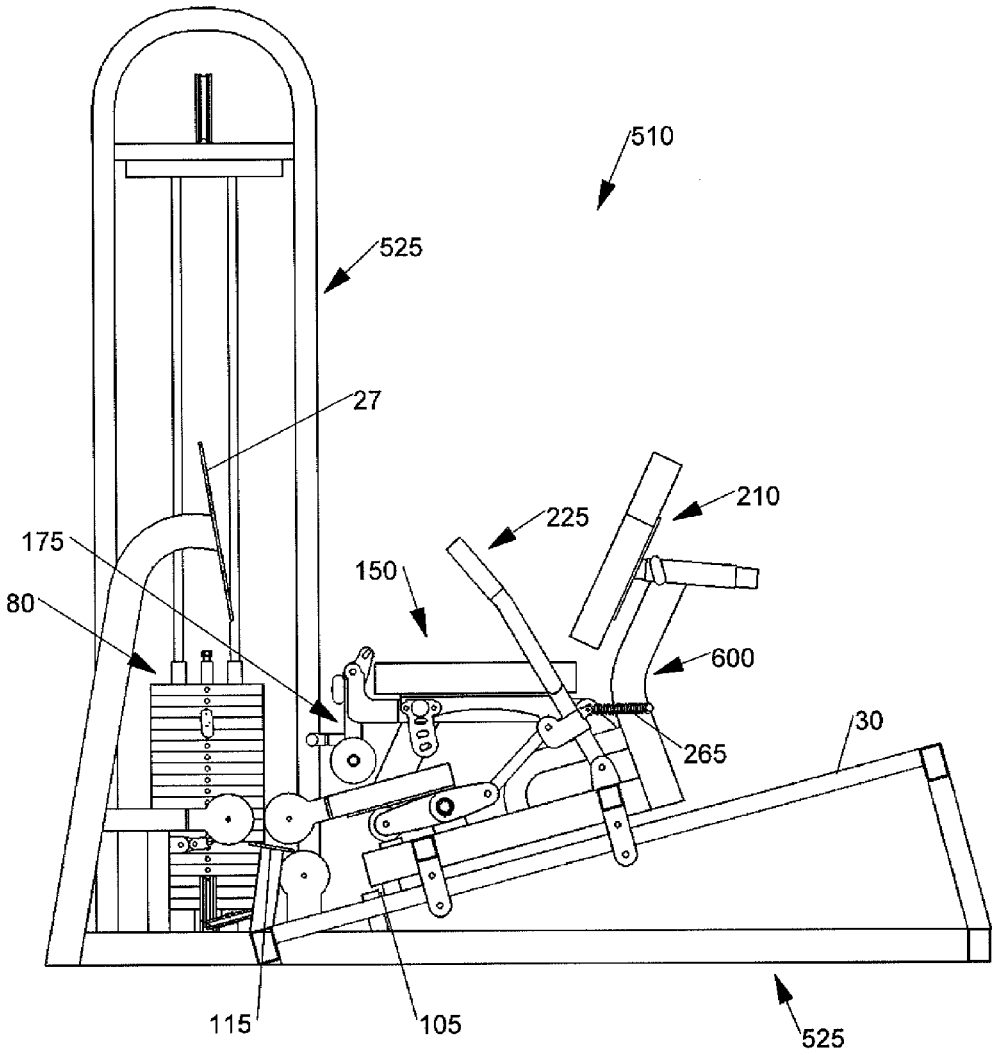
FIG. 12 is a side view illustrating an alternate embodiment leg exercise machine wherein the connector assembly by passes the sub frame and connects the user support assembly to the resistance element.
Figure 12:
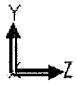

FIG. 12 illustrates an alternate embodiment leg exercise machine 510 that includes an alternate embodiment main support frame 525 and sub frame 600. There are several differences between alternate embodiment leg exercise machine 510 and exemplary embodiment leg exercise machine embodiment 10. One difference is that foot plates 115 are mounted to the main support frame 525 rather than sub frame 600. The rollers 110 mounted on the front of sub frame 600 are also positioned further towards the rear of sub frame 600 to allow foot positioning on foot plates 115 during seated calf raises. A second difference is that sub frame 600 is not directly connected to the weight stack 80. Pulley 280 is mounted to main support frame 525 rather than sub frame 600. Sub frame 600 is still indirectly connected to weight stack 80 because user support assembly 150 is pivotally mounted to sub frame 600 and user support assembly 150 is connected to weight stack 80. Bumper 105 is mounted further towards the rear of sub frame 600 to allow room to mount pulley 280 onto main support frame 525. The process to perform leg presses, extended leg calf raises, and seated calf raises is the same in this alternate embodiment as is in the exemplary embodiment.

Figure 13:
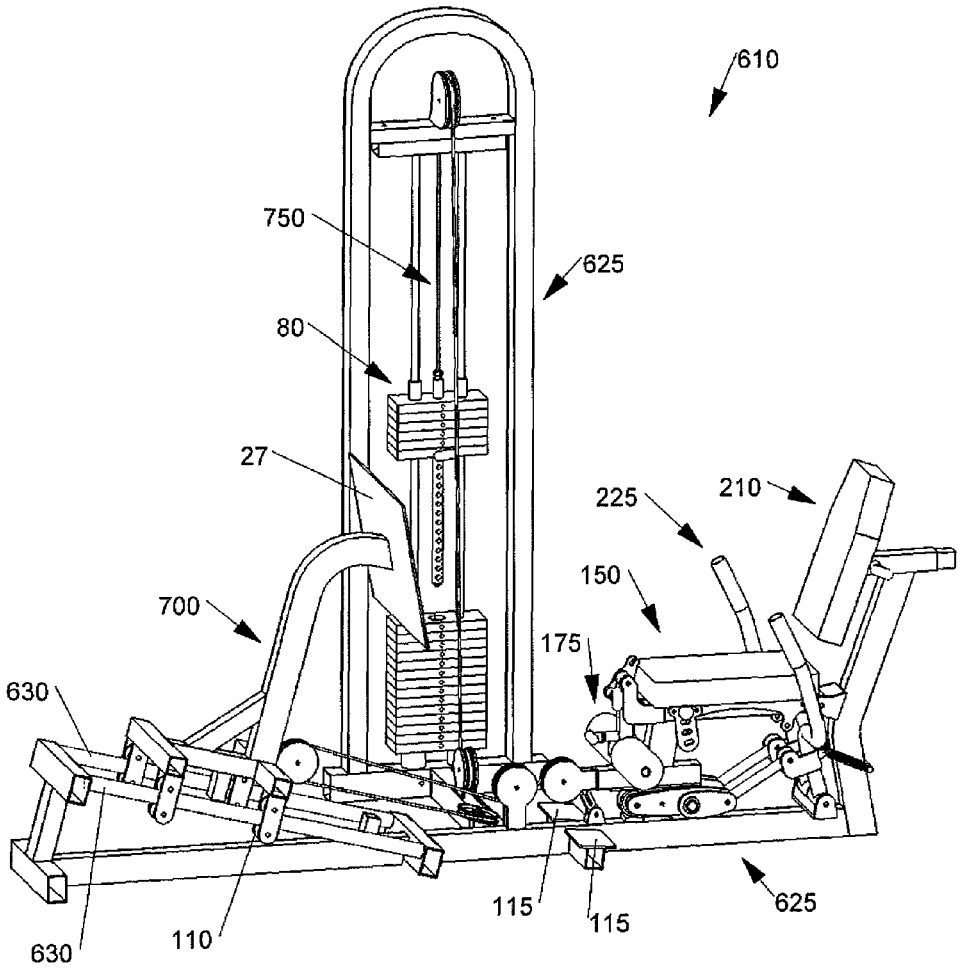
FIG. 13 is a perspective view illustrating an alternate embodiment leg exercise machine wherein a user support assembly is pivotally attached to the main support frame and is in a resting position and wherein a sub frame including a foot platform for leg presses and extended leg calf raises is linearly attached to the main support frame and is pressed into an outward position of a linear path.
Figure 13:
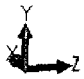
Figure 14:
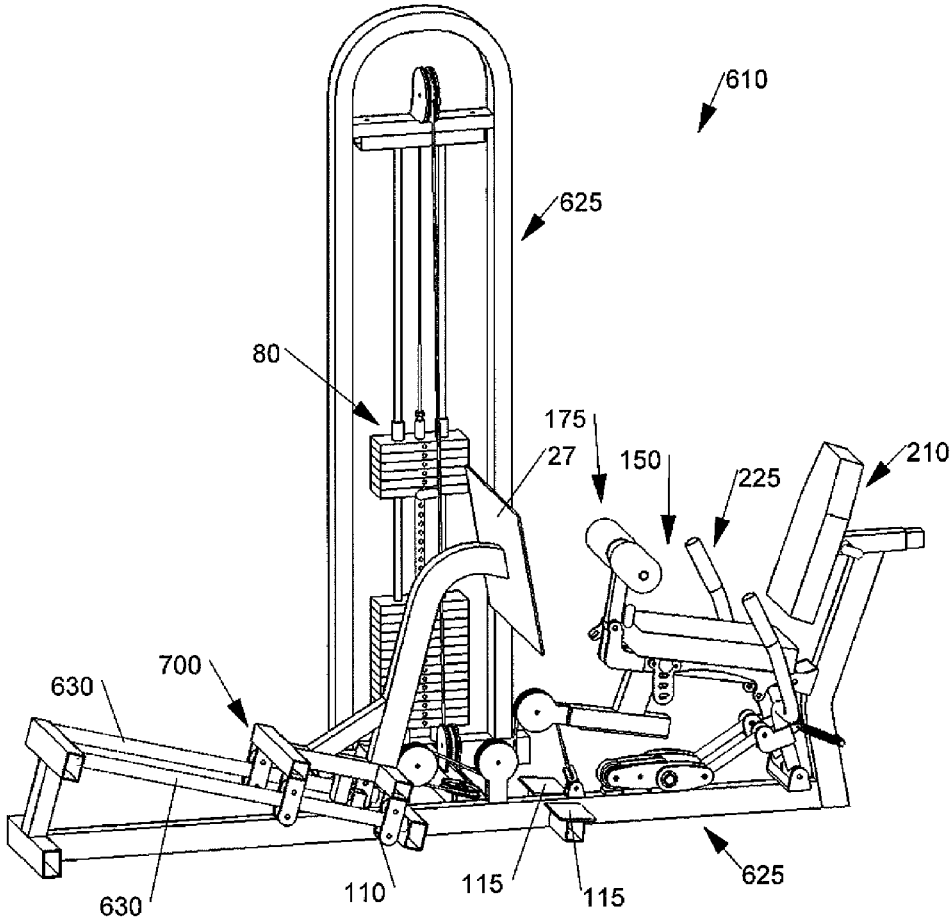
FIG. 14 is a perspective view illustrating an alternate embodiment leg exercise machine wherein a user support assembly is pivotally attached to the main support frame and is in a lifted position during seated calf raises and wherein a sub frame including a foot platform for leg presses and extended leg calf raises is linearly attached to the main support frame and is in a resting position.
Figure 14:
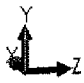

FIG. 13 illustrates an alternate embodiment leg exercise machine 610 that includes an alternate embodiment main support frame 625 and sub frame 700. Alternate embodiment leg exercise machine 610 provides means to perform linear motion leg presses, linear motion extended leg calf raises, and pivotal motion seated calf raises as does exemplary embodiment leg exercise machine 10. However, foot platform 27 is attached to sub frame 700 which is linearly attached to main support frame 625 and user support assembly 150 is pivotally attached to main support frame 625. To perform leg presses and extended leg calf raises, a user sits on user support assembly 150 and places their feet on foot platform 27 and presses outward which causes sub frame 700 to linearly travel along rods 630. This will provide resistance to the user as sub frame 700 is connected to weight stack 80 by flexible connector system 750. To perform seated calf raises, the user sits on user support assembly 150 and performs the same process as described in the exemplary embodiment. Flexible connector system 750 connects the user support assembly 150 to weight stack 80. FIG. 13 illustrates alternate embodiment leg exercise machine 610 wherein sub frame 700 is pressed to an outward position of a linear path during leg presses or extended leg calf raises, brace assembly 175 is adjusted to a storage position, and user support assembly 150 is bumpered into a rest position. FIG. 14 illustrates alternate embodiment leg exercise machine 610 wherein brace assembly 175 is adjusted to a use position, user support assembly 150 is lifted to an upward position during seated calf raises, and sub frame 700 is bumpered into a rest position.

Those skilled in the art would appreciate that any of the embodiments described could be interchanged with one another to form another embodiment of the present invention. For example, the pivot arm assembly 325 illustrated in FIGS. 8 and 9 could be used in alternate embodiment leg exercise machine 610 rather than the user support assembly 150 to perform seated calf raises.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An exercise apparatus comprising:

a main frame, said main frame including a linear track;

at least one resistance element to provide resistance for performing exercise;

a sub frame, said sub frame mounted to and linearly movable along said linear track during leg press exercise, said sub frame connected to said resistance element so that linear travel of said sub frame during leg press exercise is resisted by said resistance element;

a user support assembly for supporting a user's bottom during exercise, said user support assembly pivotally mounted to said sub frame so as to pivot up and down during seated calf raise exercise, said user support assembly connected to said resistance element so that rotation of said user support assembly is resisted by said resistance element;

a first foot platform for pressing with the bottom of one or both of said user's feet during leg press exercise;

a second foot platform for supporting the bottom of one or both of said user's feet during seated calf raise exercise, said second foot platform positioned lower than said first foot platform; and a brace pad assembly including at least one brace pad movably mounted to said user support assembly, wherein said brace pad is movable between a first position above said user's knees for engaging said user's legs during seated calf raise exercise, and a second position storing said brace pad assembly so as to not interfere with said user's legs during leg press exercise.

2. The exercise apparatus of claim 1 further comprising a flexible connector system coupled to said resistance element and comprising at least one flexible line, said flexible connector system connecting said sub frame and said user support assembly to said resistance element wherein said resistance element resists linear travel of said sub frame during leg press exercise and resists rotation of said user support assembly during seated calf raise exercise.

3. The exercise apparatus of claim 1 wherein said brace pad assembly is pivotally mounted to said user support assembly.

4. The exercise apparatus of claim 3 wherein said brace pad assembly is telescopically adjustable.

5. The exercise apparatus of claim 1 wherein said brace pad assembly is slidingly attached to said user support assembly.

6. The exercise apparatus of claim 1 wherein said second foot platform is fixedly attached to said sub frame.

7. The exercise apparatus of claim 1 wherein said second foot platform is fixedly attached to said main frame.

8. The exercise apparatus of claim 1 wherein said user support assembly includes a bottom seat assembly including a bottom seat pad and wherein said bottom seat assembly is pivotally mounted to said user support assembly so that said bottom seat pad is angularly adjustable.

9. The exercise apparatus of claim 1 further comprising a multi-function handle bar assembly pivotally mounted to said sub frame.

10. The exercise apparatus of claim 9 wherein said multi-function handle bar assembly comprises at least one handle interconnected with at least one wheel so that pressing said handle forward will raise said wheel and lift said user support assembly upward.

11. An exercise apparatus comprising:

a main frame, said main frame including a linear track;

at least one resistance element to provide resistance for performing exercise;

a sub frame, said sub frame mounted to and linearly movable along said linear track during leg press exercise, said sub frame connected to said resistance element so that linear travel of said sub frame during leg press exercise is resisted by said resistance element;

a bottom seat and a back seat to support a user during exercise, said bottom seat and back seat attached to said sub frame;

a pivot arm assembly pivotally mounted to said sub frame so as to pivot up and down during seated calf raise exercise, said pivot arm assembly connected to said resistance element so that rotation of said pivot arm assembly is resisted by said resistance element;

a first foot platform for pressing with the bottom of one or both of said user's feet during leg press exercise;

a second foot platform for supporting the bottom of one or both of said user's feet during seated calf raise exercise, said second foot platform positioned lower than said first foot platform; and a brace pad assembly including at least one brace pad movably mounted to said pivot arm assembly, wherein said brace pad is movable between a first position above said user's knees for engaging said user's legs during seated calf raise exercise, and a second position storing said brace pad assembly so as to not interfere with said user's legs during leg press exercise.

12. The exercise apparatus of claim 11 further comprising a flexible connector system coupled to said resistance element and comprising at least one flexible line, said flexible connector system connecting said sub frame and said pivot arm assembly to said resistance element wherein said resistance element resists linear travel of said sub frame during leg press exercise and resists rotation of said user support assembly during seated calf raise exercise.

13. The exercise apparatus of claim 11 wherein said brace pad assembly is pivotally mounted to said pivot arm assembly.

14. The exercise apparatus of claim 11 wherein said second foot platform is fixedly attached to said sub frame.

15. The exercise apparatus of claim 11 wherein said second foot platform is fixedly attached to said main frame.

16. The exercise apparatus of claim 11 wherein said bottom seat is pivotally attached to said sub frame and said back seat is linearly attached to said sub frame.

17. The exercise apparatus of claim 11 further comprising a multi-function handle bar assembly pivotally mounted to said sub frame.

18. The exercise apparatus of claim 17 wherein said multi-function handle bar assembly comprises at least one handle interconnected with at least one wheel so that pressing said handle forward will raise said wheel and lift said pivot arm assembly upward.

19. An exercise apparatus comprising:

a main frame, said main frame including a linear track;

at least one resistance element to provide resistance for performing exercise;

a sub frame, said sub frame mounted to and linearly movable along said linear track during leg press exercise;

a first foot platform for pressing with the bottom of one or both of a user's feet during leg press exercise, said first foot platform attached to said sub frame;

a user support assembly for supporting a user's bottom during exercise, said user support assembly pivotally mounted to said main frame so as to pivot up and down during seated calf raise exercise;

a second foot platform for supporting the bottom of one or both of said user's feet during seated calf raise exercise, said second foot platform positioned lower than said first foot platform;

a brace pad assembly including at least one brace pad movably mounted to said user support assembly, wherein said brace pad is movable between a first position above said user's knees for engaging said user's legs during seated calf raise exercise, and a second position storing said brace pad assembly so as to not interfere with said user's legs during leg press exercise; and a flexible connector system coupled to said resistance element and comprising at least one flexible line, said flexible connector system connecting said sub frame and said user support assembly to said resistance element wherein said resistance element resists linear travel of said sub frame during leg press exercise and resists rotation of said user support assembly during seated calf raise exercise.

* * * * *